US006782227B2

(12) United States Patent
Ishibashi et al.

(10) Patent No.: US 6,782,227 B2
(45) Date of Patent: Aug. 24, 2004

(54) TRANSFER DEVICE FOR SETTING A SUITABLE RECORDING MEDIUM ADSORBING BIAS, AND AN IMAGE-FORMING APPARATUS INCLUDING THE TRANSFER DEVICE

(75) Inventors: Hitoshi Ishibashi, Kamakura (JP); Atsushi Takehara, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 97 days.

(21) Appl. No.: 10/263,802

(22) Filed: Oct. 4, 2002

(65) Prior Publication Data

US 2003/0108367 A1 Jun. 12, 2003

(30) Foreign Application Priority Data

Oct. 4, 2001 (JP) ..... 2001-308529

(51) Int. Cl.[7] ..... G03G 15/16
(52) U.S. Cl. ..... 399/303; 399/66; 399/314
(58) Field of Search ..... 399/303, 310, 399/312, 313, 314, 66, 297; 430/126

(56) References Cited

U.S. PATENT DOCUMENTS

| | | | | |
|---|---|---|---|---|
| 5,438,401 A | | 8/1995 | Murayama et al. | 399/228 |
| 5,623,330 A | | 4/1997 | Ishibashi | 399/310 |
| 5,659,843 A | | 8/1997 | Takano et al. | 399/66 |
| 5,907,758 A | * | 5/1999 | Tanaka et al. | 399/303 |
| 6,249,304 B1 | | 6/2001 | Sawayama et al. | 347/228 |
| 6,292,206 B1 | | 9/2001 | Takehara et al. | 347/133 |
| 6,295,438 B1 | | 9/2001 | Fujishiro et al. | 399/346 |
| 6,334,039 B1 | | 12/2001 | Yoshinaga et al. | 399/298 |
| 6,356,733 B1 | * | 3/2002 | Hino et al. | 399/303 |
| 6,360,065 B1 | | 3/2002 | Ishibashi et al. | 399/174 |
| 6,366,754 B1 | | 4/2002 | Sato et al. | 399/223 |
| 6,449,454 B1 | * | 9/2002 | Ito | 399/303 |
| 6,564,020 B2 | * | 5/2003 | Kuribayashi et al. | 399/314 X |

FOREIGN PATENT DOCUMENTS

| | | |
|---|---|---|
| JP | 63-118780 | 5/1988 |
| JP | 05-270686 | 10/1993 |
| JP | 07-199679 | 8/1995 |
| JP | 08-152790 | 6/1996 |
| JP | 09-006153 | * 1/1997 |
| JP | 2001-109325 | 4/2001 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A transfer device that transfers color visual images of different colors from image carriers to each of first and second sides of a recording medium. The transfer device includes a transfer element that holds and moves the recording medium, transfer bias applying devices that apply transfer biases to the recording medium by the transfer element to transfer the color visual images from the image carriers to the recording medium, respectively, and an adsorbing bias applying device that applies an adsorbing bias to the recording medium to adsorb the recording medium to the transfer element. A polarity of the adsorbing bias applied to the second side of the recording medium is opposite to that of electric charge given to the recording medium due to electric discharge generated when the recording medium is separated from the image carriers after passing through transfer nip parts formed between the image carriers and the transfer bias applying devices.

24 Claims, 6 Drawing Sheets

TRANSFER DEVICE FOR SETTING A SUITABLE RECORDING MEDIUM ADSORBING BIAS, AND AN IMAGE-FORMING APPARATUS INCLUDING THE TRANSFER DEVICE

CROSS-REFERENCE TO RELATED APPLICATIONS

The present application claims priority to Japanese Patent Application No. 2001-308529 filed in the Japanese Patent Office on Oct. 4, 2001, the disclosure of which is incorporated herein by reference.

BACKGROUND OF THE INVENTION

1. Field of the Invention

The present invention relates to a transfer device and an image-forming apparatus including the transfer device, and more particularly to the control of an adsorbing bias applied to a surface of a recording medium so that the recording medium is electrostatically adsorbed to a transfer element.

2. Discussion of the Background

In an image-forming apparatus such as a copying machine, a printer, a facsimile machine, or other similar image-forming apparatus, an electrostatic latent image formed on a photoreceptor functioning as an image carrier is developed with toner to obtain a visual image, i.e., a toner image. Next, the toner image is transferred onto a recording medium such as a recording sheet in a transfer process.

With regard to the transfer process, in the case of single color image formation, a toner image may be directly transferred from a photoreceptor to a recording sheet. In the case of multi-color image formation, toner images of different colors formed on a photoreceptor may be sequentially transferred onto an intermediate transfer element, i.e., a primary transfer, while being superimposed upon each other on the intermediate transfer element. The superimposed multi-color image on the intermediate transfer element may be collectively transferred onto a recording sheet, i.e., a secondary transfer.

An intermediate transfer element may be shaped in the form of drum or a belt. When the intermediate transfer element is shaped in the form of a belt (hereafter referred to as an "intermediate transfer belt"), instead of collectively transferring a superimposed multi-color image onto a recording sheet fed from a sheet feeding device, it has been proposed that a recording sheet is adsorbed to the intermediate transfer belt. Further, toner images of different colors formed on respective photoreceptors are sequentially transferred onto the recording sheet, which moves together with the intermediate transfer belt, while being superimposed upon each other on the recording sheet. This technology is described in, for example, Japanese Laid-open Patent Publication Nos. 63-118780, 5-270686, and 8-152790.

The above-described Japanese Laid-open Patent Publication Nos. 63-118780, 5-270686, and 8-152790 employ a construction in which a plurality of photoreceptors arranged along the intermediate transfer belt in the direction of movement of the intermediate transfer belt, and toner images of different colors formed on the respective photoreceptors are sequentially transferred onto one side of a recording sheet adsorbed to the intermediate transfer belt. That is, the construction allows an image to form on only one side of the recording sheet. Another construction is described, for example, in Japanese Laid-open Patent Publication No. 2001-109325, in which toner images of different colors formed on respective photoreceptors are sequentially transferred onto a first (front) side of a recording sheet, and then subsequent toner images of different colors are sequentially transferred onto a second (rear) side of the recording sheet.

An image-forming apparatus in which a plurality of image-forming units (including photoreceptors) are arranged along an intermediate transfer belt as an intermediate transfer element in the direction of movement of the intermediate transfer belt is called a tandem-type image-forming apparatus. A tandem-type image-forming apparatus often uses toner of four colors, including black toner.

In the above-described background transfer constructions, toner images of different colors are sequentially transferred from photoreceptors onto a recording sheet by applying a transfer bias to the recording sheet via an intermediate transfer belt (hereafter referred to as a "transfer belt") each time the recording sheet passes transfer positions. As a result, the charge of the recording sheet increases by applying a transfer bias to the recording sheet.

For example, in a multi-color image-forming apparatus that has been widely used recently, an electrostatic latent image formed on a negatively charged photoreceptor is developed with negatively charged toner and formed into a toner image. In the transfer process, the toner image is transferred onto a recording sheet by applying a transfer bias having a positive polarity with respect to the recording sheet. In this image-forming process, each time the recording sheet is separated from the photoreceptor when passing transfer positions, electric discharge is generated between the photoreceptor and the recording sheet. As a result, the negative charge of the recording sheet becomes higher each time the recording sheet passes the transfer positions.

When forming images on both sides of a recording sheet, after the transfer process for the first side of the recording sheet is completed, a subsequent transfer process for the second side of the recording sheet is performed. In this case, a bias for adsorbing a recording sheet to a transfer belt (hereafter referred to as an "adsorbing bias") to be applied to the second side of the recording sheet must be changed from that applied to the first side of the recording sheet. The adsorbing bias is changed according to the change of electric resistance of the recording sheet caused by the change of humidity of the recording sheet in the fixing process performed after the transfer process for the first side of the recording sheet. In the fixing process, a toner image is fixed onto the recording sheet under the influence of heat and pressure. Thus, by having to change the adsorbing bias applied to the second side of the recording sheet from that applied to the first side of the recording sheet, adsorbing bias control becomes complicated.

In order to improve the above-described negative charging condition of a recording sheet, a background image-forming apparatus may use a discharging AC charger. For example, Japanese Laid-open Patent Publication No. 7-199679 describes an image-forming apparatus in which, after completion of a transfer process for the first side of a recording sheet, a discharging AC charger discharges the recording sheet. Subsequently, a transfer process for the second side of the recording sheet is performed without changing the adsorbing bias to be applied to the second side of the recording sheet from that applied to the first side of the recording sheet.

However, with increasing demands for environmental protection, such as reduction of ozone production, and for cost reduction of an apparatus, an image-forming apparatus tends to have a construction that lacks a discharging device like the discharging AC charger. In a construction without a discharging device, a negative electric charge given to a recording sheet in a transfer process for the first side of the recording sheet must be cancelled by re-charging the recording sheet, before performing a transfer process for the second side of the recording sheet. In this case, an adsorbing bias having an opposite polarity (i.e., a positive polarity) may be required to be applied to the recording sheet so as to cancel the negative electric charge given to the recording sheet in transfer operations which are repeated four times in the transfer process for the first side of the recording sheet.

When forming images on both sides of a recording sheet, the charging conditions of the first and second sides of the recording sheet may be different, due to the difference of humidity between the first and second sides of the recording sheet. When forming an image on the second side of a recording sheet, since the percentage of moisture content of the recording sheet decreases after the fixing process for the first side of the recording sheet, the second side of the recording sheet tends to have a high resistance compared to the first side of the recording sheet. Therefore, when a transfer operation for each color is repeated for the second side of the recording sheet, a negative electric charge generated in the transfer process remains on the second side of the recording sheet. Thus, the second side of the recording sheet has a considerably high negative charge compared to the first side of the recording sheet. As a result, negatively charged toner transferred onto the second side of the recording sheet is in an electrically unstable condition. This causes toner scattering, in which electrically unstable toner of a toner image on the second side of the recording sheet scatters when the recording sheet is separated from a transfer belt (after completion of the transfer process for the second side of the recording sheet).

Therefore, considering the high resistance and high charging condition of the second side of the recording sheet, a high adsorbing bias, having a polarity opposite to that of the electric charge given to the recording sheet in the transfer process for the first side of the recording sheet, may need to be applied to the recording sheet before performing the transfer process for the second side of the recording sheet. For example, when the electric charge given to the recording sheet in the transfer process for the first side of the recording sheet has a negative polarity, the adsorbing bias applied to the recording sheet before the transfer process for the second side of the recording sheet may need to have a positive polarity to cancel the negative electric charge given to the recording sheet.

Next, consideration will be given to an adsorbing bias applied to a recording sheet when forming an image on the first side of the recording sheet in a dual-side image-forming mode.

When forming an image on the first side of a recording sheet, which depends on environmental conditions that influence the percentage of moisture content of a recording sheet, the recording sheet tends to have a low resistance under the high humidity condition, due to an increase in the moisture content of the recording sheet. With such a low resistance of the recording sheet, when an adsorbing bias having a polarity (e.g., negative) opposite to that of a transfer bias (e.g., positive) is applied to an adsorbing bias applying device, an electric field between the adsorbing bias applying device and a transfer bias applying device for the first color toner image increases. Thus, a positive transfer bias charge flows into the adsorbing bias applying device through the recording sheet. As a result, an inferior transfer of a first color toner image occurs. Specifically, when the recording sheet has a surface resistivity of, for example, $5\times10^{10}$ Ω/square, an image in which a first color is conspicuous is formed. This phenomenon tends to occur when the space between the adsorbing bias applying device and the transfer bias applying device for the first color toner image is reduced for downsizing the apparatus.

On the other hand, when the polarities of the adsorbing bias and the transfer bias are different, and when a recording sheet has a high resistance, the recording sheet is charged with the negative adsorbing bias applied from the adsorbing bias applying device. As transfer operations are repeated at transfer positions, the negative charge of the recording sheet increases, thereby causing an inferior transfer in which a negatively charged toner image is not smoothly transferred from a photoreceptor to the recording sheet (even though the positive transfer bias is applied to the recording sheet). As a result, a deteriorated image tends to be obtained. In addition, for increasing the transfer bias voltage in succeeding transfer operations in order to prevent image transfer efficiency from decreasing, a power supply having a big electric power capacity needs to be provided to increase the transfer bias voltage at transfer positions located downstream in the sheet-moving direction. This may increase the cost of the apparatus. For the above-described reasons, when performing the transfer process for the first side of the recording sheet, the adsorbing bias and the transfer bias preferably have the same polarities.

When an adsorbing bias having a polarity (e.g., positive) equal to that of a transfer bias (e.g., positive) is applied to the adsorbing bias applying device, the electric field between the adsorbing bias applying device and the transfer bias applying device for the first color toner image attenuates. However, when a recording sheet has low resistance, a positive adsorbing bias charge flows to a negatively charged photoreceptor carrying the first color toner image through the recording sheet. As a result, an excess amount of the transfer bias is produced, thereby deteriorating the image. Particularly, when the recording sheet has a surface resistivity of, for example, $5\times10^{10}$ Ω/square, an image in which a toner image is partially omitted is formed. Because, such a problem tends to occur as the adsorbing bias increases, the value of the adsorbing bias can not be set to be high.

On the other hand, when the polarities of the adsorbing bias and the transfer bias are the same, and when a recording sheet has high resistance, the recording sheet is charged with the positive adsorbing bias applied from the adsorbing bias applying device. As a result, the positively charged recording sheet tends to be electrostatically attracted toward the negatively charged photoreceptor. For example, when the value of the adsorbing bias is set to be relatively high, the recording sheet, which has passed a transfer position corresponding to a transfer nip part formed between the photoreceptor and the transfer bias applying device via the transfer belt, is adsorbed to the photoreceptor, instead of to the transfer belt. Thus, the recording sheet is wrapped around a part of the photoreceptor, resulting in a sheet jam. Such a sheet jam typically occurs when a thin paper having a small flexural rigidity and a basis weight of about 55 g/m$^2$ is used as a recording sheet.

In a tandem-type image-forming apparatus, in which toner images formed at each image forming unit are sequentially transferred from the photoreceptors directly to a recording sheet, the recording sheet must be securely adsorbed to the transfer belt. By setting the polarity of the adsorbing bias applied to the recording sheet to be the same as that of the transfer bias, the electric charge on the recording sheet is discharged. In the transfer process for the first side of the recording sheet, before the adsorbing bias is applied to the recording sheet, the surface potential of the recording sheet is close to zero because the recording sheet is not charged. In this condition, when the adsorbing bias equals the transfer bias for a first color toner image, the surface potential of the recording sheet becomes nearly zero after the recording sheet passes through a transfer nip part formed between the photoreceptor and the transfer bias applying device for the first color toner image. In such a condition, the adsorbing force of the recording sheet to the transfer belt is lost. Thus, the recording sheet may not be adequately conveyed. Due to inferior sheet conveyance, deviation of the position of color toner images may occur.

SUMMARY OF THE INVENTION

According to a first aspect of the present invention, a transfer device that transfers at least one color visual image from at least one image carrier to each of first and second sides of a recording medium, includes a transfer element configured to hold and move the recording medium, at least one transfer bias applying device configured to apply a transfer bias to the recording medium by the transfer element in order to transfer the at least one color visual image from the at least one image carrier to the recording medium while the recording medium passes through at least one transfer nip part formed between the at least one image carrier and the at least one transfer bias applying device, and an adsorbing bias applying device configured to apply a first adsorbing bias to the first side and a second adsorbing bias to the second side of the recording medium to adsorb the recording medium to the transfer element. The adsorbing bias applying device is provided upstream of the at least one transfer bias applying device in a direction of movement of the recording medium. A polarity of the second adsorbing bias applied to the second side of the recording medium is opposite to a polarity of electric charge given to the recording medium due to electric discharge generated when the recording medium is separated from the at least one image carrier after passing through the at least one transfer nip part.

According to another aspect of the present invention, a method of forming an image, includes forming at least one color visual image on the at least one image carrier, applying a first adsorbing bias to a first side and a second adsorbing bias to a second side of a recording medium to adsorb the recording medium to a transfer element from an adsorbing bias applying device, applying a transfer bias to the recording medium from at least one transfer bias applying device by the transfer element, and transferring the at least one color visual image from the at least one image carrier to each of the first and second sides of the recording medium while the recording medium passes through at least one transfer nip part formed between the at least one image carrier and the at least one transfer bias applying device. In the step of applying the adsorbing bias, a polarity of the second adsorbing bias applied to the second side of the recording medium is opposite to a polarity of electric charge given to the recording medium due to electric discharge generated when the recording medium is separated from the at least one image carrier after passing through the at least one transfer nip part.

Other objects, features, and advantages of the present invention will become apparent from the following detailed description, when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
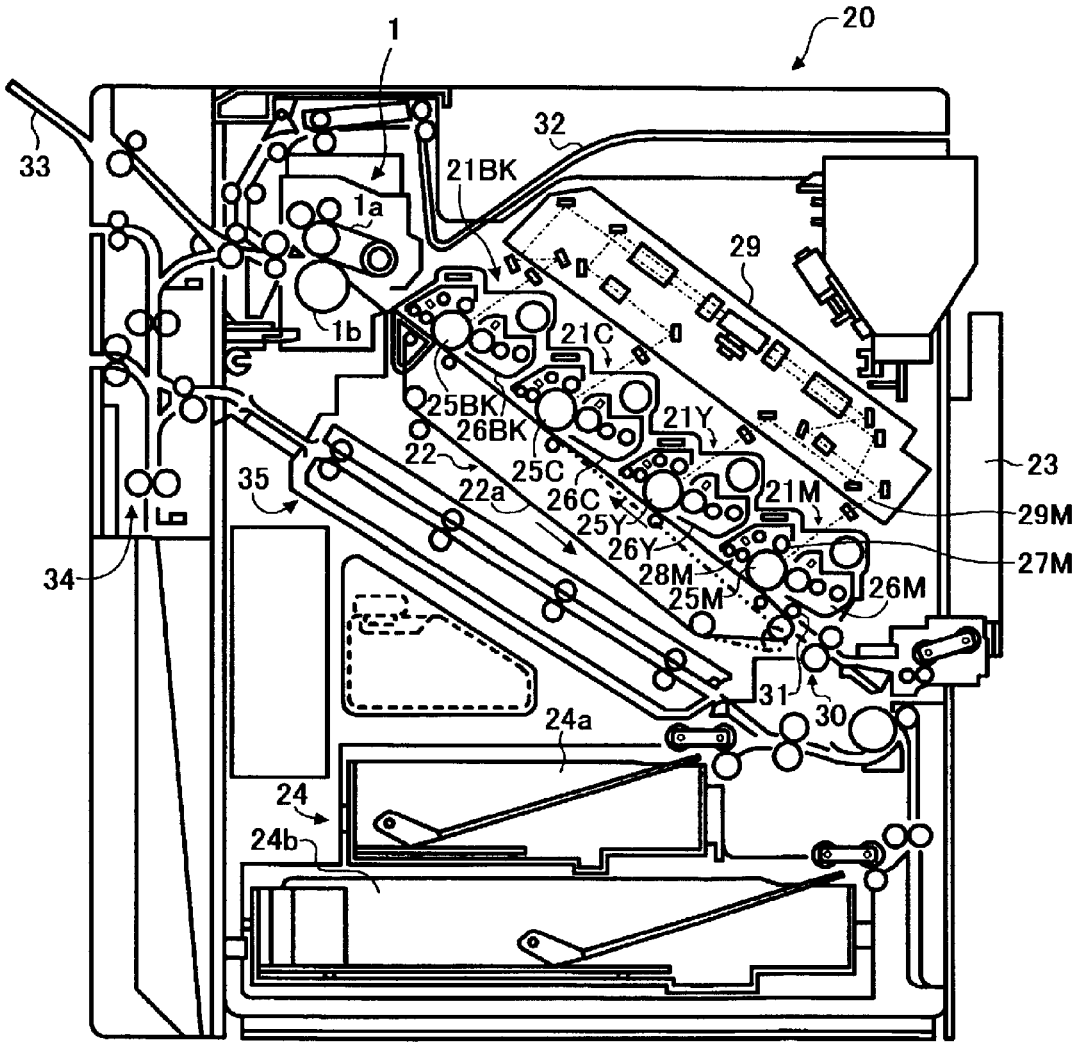
FIG. 1 is a schematic view of an image forming apparatus including a transfer device according to one embodiment of the present invention.

Preferred embodiments of the present invention are described in detail referring to the drawings, wherein like reference numerals designate identical or corresponding parts throughout the several views.

FIG. 1 is a schematic view of an image forming apparatus including a transfer device according to one embodiment of the present invention. Examples of the image-forming apparatus illustrated in FIG. 1 include a copying machine and a printer that form multi-color images. In addition to the copying machine and printer, a facsimile machine that performs an image-forming process in a manner similar to the copying machine and printer in accordance with received image signals may be used as the image-forming apparatus. Further, the image-forming apparatus may form single-color images instead of multi-color images.

An image-forming apparatus 20 illustrated in FIG. 1 uses a method in which toner images as visual images of different colors are sequentially transferred from image carriers directly to a recording sheet as a recording media while being superimposed upon each other on the recording sheet. The recording sheet is electrostatically adsorbed to a transfer belt as a transfer element (described below).

Referring to FIG. 1, the image-forming apparatus 20 includes image-forming units 21M, 21C, 21Y, and 21BK that form respective color toner images corresponding to a multi-color image of an original document; a transfer device 22 arranged opposite to the image-forming units 21M, 21C, 21Y, and 21BK; and sheet-feeding devices, such as a manual feeding tray 23 and a sheet feeding device 24 (including a first sheet feeding cassette 24*a* and a second sheet feeding cassette 24*b*) that feed a recording sheet to a transfer station between the respective image-forming units 21M, 21C, 21Y, and 21BK and the transfer device 22. The image-forming apparatus 20 further includes registration rollers 30, which rotate to feed the recording sheet fed from any one of the manual sheet-feeding tray 23 and the sheet feeding cassettes 24*a* and 24*b* to the transfer station at a time of image forming by the image forming units 21M, 21C, 21Y, and 21BK; and a fixing device 1, which fixes the transferred color toner image onto the recording sheet.

The transfer device 22 includes a transfer belt 22*a* as a transfer element spanning a plurality of rollers, and transfer bias devices 22M, 22C, 22Y, and 22BK that apply a transfer bias to the transfer belt 22*a* at respective positions where the transfer bias devices 22M, 22C, 22Y, and 22BK respectively oppose photoconductive drums 25M, 25C, 25Y, and 25BK in the image-forming units 21M, 21C, 21Y, and 21BK via the transfer belt 22*a* (details of which will be described below referring to FIG. 2). The transfer device 22 further includes an adsorbing bias applying roller 31 as an adsorbing bias applying device that applies an adsorbing bias to the recording sheet to adsorb the recording sheet to the transfer belt 22*a* before a transfer process for the first color toner image is performed. The adsorbing bias applying roller 31 is provided upstream of the transfer station for the first color toner image in a moving direction of the transfer belt 22*a*, indicated by the arrows on the transfer belt 22*a* in FIG. 1, such that the adsorbing bias applying roller 31 can contact the transfer belt 22*a*.

The image forming apparatus 20 uses various types of recording sheets, such as a plain paper, generally used in a copying machine, or special sheets having larger thermal capacity than that of the plain paper, such as an overhead transparency film sheet, a card, a postcard, a thick paper having a basis weight of about 100 g/m$^2$ or greater, or an envelope.

Figure 2:
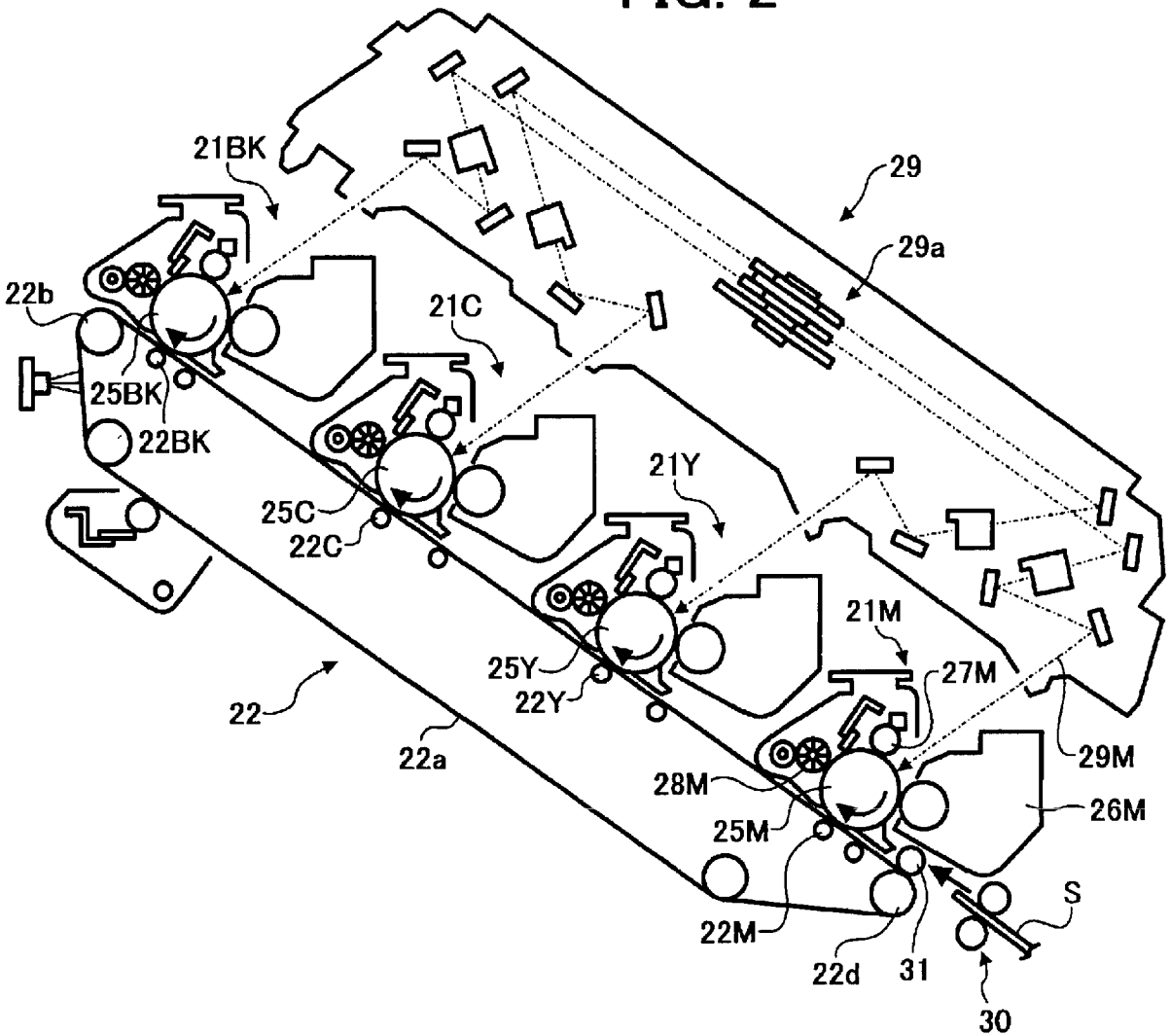
FIG. 2 is an enlarged schematic view of image forming units and the transfer device of FIG. 1.

FIG. 2 is an enlarged schematic view of the image-forming units 21M, 21C, 21Y, and 21BK and the transfer device 22 of FIG. 1. The image forming units 21M, 21C, 21Y, and 21BK form magenta, cyan, yellow, and black toner images, respectively, and their configurations are substantially the same except for the color of their toner. For this reason, only the configuration of the image forming unit 21M will be described hereinafter.

The image-forming unit 21M includes a drum-shaped photoreceptor 25M (hereafter referred to as a "photoconductive" drum 25M) serving as an image carrier. Arranged around the photoconductive drum 25M are a charging device 27M, a developing device 26M, and a cleaning device 28M, in the order of the rotational direction of the photoconductive drum 25M, i.e., a clockwise direction indicated by the arrow on the photoconductive drum 25M in FIG. 2. Corresponding developing devices 26BK, 26C, and 26Y are included in the image forming units 21BK, 21C, and 21Y, respectively. An image writing device 29 exposes the surface of the photoconductive drum 25M between the charging device 27M and the developing device 26M with a laser light 29M to form an electrostatic latent image in accordance with image information corresponding to a multi-color image of an original document. As an alternative image carrier, a belt-shaped photoreceptor may be employed instead of the photoconductive drum 25M.

In the image-forming apparatus 20 illustrated in FIG. 1, the transfer device 22 extends while being downwardly slanted. Therefore, the space occupied by the transfer device 22 in a horizontal direction in the image-forming apparatus 20 can be saved.

The image-forming apparatus 20 performs image-forming operations based on processes and conditions in the following manner. A description will be given of an image-forming operation of the image-forming unit 21M using magenta toner as being representative. Image-forming operations are performed in the image-forming units 21Y, 21C, and 21BK in a manner similar to the image forming unit 21M.

Upon starting an image-forming cycle, the photoconductive drum 25M is driven to rotate by a main motor (not shown) and is discharged with an AC bias (DC component is zero) applied from the charging device 27M, and thereby the surface potential of the photoconductive drum 25M is set to a reference potential of approximately −50V.

Subsequently, the photoconductive drum 25M is uniformly charged with a DC bias, with an AC bias superimposed thereupon applied from the charging device 27M at a potential substantially equal to a DC component, and thereby the surface potential of the photoconductive drum 25M is set in a range from approximately −500V to −700V (the target charging potential is determined by a process control section).

When the photoconductive drum 25M is uniformly charged, an image-writing process is performed. The image-writing device 29 exposes the surface of the photoconductive drum 25M with the laser light 29M to form an electrostatic latent image in accordance with digital image information sent from a controller (not shown). The laser light 29M emitted from a laser light source in accordance with binary light-emitting signals for each color corresponding to the digital image information passes through a cylinder lens (not shown), a polygonal mirror 29*a*, an f-theta lens (not shown), first through third mirrors (not shown), and a long toroidal (WTL) lens (not shown) toward the surface of the photoconductive drums 25M, thereby forming the electrostatic latent image corresponding to the image information on the surface of the photoconductive drum 25M. The surface potential of the exposed portion of the photoconductive drum 25M is approximately −50V.

The electrostatic latent image formed on the photoconductive drum 25M is developed with magenta toner by the developing device 26M. In the development process, a DC bias in a range from −300V to −500V, with an AC bias superimposed thereupon, is applied to a developing sleeve (not shown) of the developing device 26M. An image portion where the potential is attenuated by the irradiation of the laser light 29M is developed with magenta toner (toner charging amount: −20 to −30 $\mu$C/g), thereby forming a magenta toner image on the photoconductive drum 25M.

After the development process, toner images of respective colors are sequentially transferred onto the recording sheet fed out from the registration rollers 30 at an appropriate timing in the transfer process. Before reaching the transfer belt 22*a*, the recording sheet is electrostatically adsorbed to the transfer belt 22*a* by applying an adsorbing bias to the recording sheet from the adsorbing bias applying roller 31.

Toner images of respective colors are sequentially and electrostatically transferred from the photoconductive drums 25M, 25C, 25Y, and 25BK onto the recording sheet (which is indicated by a reference character "S" in FIG. 2) and electrostatically adsorbed to the transfer belt 22*a* and moved together with the transfer belt 22*a* by applying a transfer bias having a polarity opposite to that of the color toner to the transfer belt 22*a* by the respective transfer bias applying devices 22M, 22C, 22Y, and 22BK, provided in the transfer device 22 at positions facing the photoconductive drums 25M, 25C, 25Y, and 25BK, respectively.

The recording sheet passing the transfer positions for respective color toner images is separated from the transfer belt 22*a* at a drive roller 22*b* that drives the transfer belt 22*a* to rotate. Then, the recording sheet is conveyed to the fixing device 1. In the fixing device 1, the transferred color toner image is fixed onto the recording sheet while the recording sheet passes through a fixing nip part formed between a fixing belt 1*a* and a pressure roller 1*b*.

After the fixing process, the recording sheet is discharged to one of a sheet discharging/stacking part 32 and a sheet discharging tray 33 in a single side image-formation mode in which an image is formed on only the first side of the recording sheet.

The image forming apparatus 20 has a configuration that allows images to be formed on dual sides (the first and second sides) of the recording sheet. When a dual-side image-forming mode is selected, the recording sheet passed through the fixing device 1 is directed to a reversing unit 34, and is reversed in the reversing unit 34. Subsequently, the reversed recording sheet is conveyed to a sheet conveying unit 35. The recording sheet conveyed from the sheet conveying unit 35 is again conveyed to the transfer position via the registration rollers 30. After the transfer and fixing processes for the second side of the recording sheet, the recording sheet having images on dual sides thereof is discharged to one of the sheet discharging/stacking part 32 and the sheet discharging tray 33.

As described above, the transfer device 22 includes the transfer belt 22*a* and the adsorbing bias applying roller 31 that applies an adsorbing bias to the recording sheet to adsorb the recording sheet to the transfer belt 22*a*.

The transfer belt 22*a* includes a single layer of about 100 μm in thickness and is made of polyvinylidene fluoride (PVDF). A volume resistivity of the transfer belt 22*a* is adjusted from approximately $5\times10^{9}$ to approximately $5\times10^{11}$ Ω-cm by an ionic conductor.

For measuring the volume resistivity of the transfer belt 22*a*, the resistance meter (Hiresta IP MCP-HT260, available from Mitsubishi Chemical Corporation), to which an HRS probe had been connected, was used. To obtain the volume resistivity of the transfer belt 22*a*, the current value measured by the above-described resistance meter ten seconds after applying the voltage of +500V across the front and rear surfaces of the transfer belt 22*a* was employed. In the present embodiment, the lower limit of the volume resistivity of the transfer belt 22*a* is determined by the lower limit of the adsorbing force of the recording sheet relative to the transfer belt 22*a*, and the upper limit of the volume resistivity of the transfer belt 22*a* is determined by an upper limit that can allow the transfer belt 22*a* to self-discharge.

The transfer bias applying devices 22M, 22C, 22Y, and 22BK constructed with, for example, rollers, are arranged at positions opposite to the photoconductive drums 25M, 25C, 25Y, and 25BK, respectively, via the transfer belt 22*a*. The rollers of the transfer bias applying devices 22M, 22C, 22Y, and 22BK are rotatably provided in contact with the transfer belt 22*a* to apply transfer biases to the transfer belt 22*a*.

The adsorbing bias applying roller 31 includes a core metal having an outer diameter of approximately 6 mm, and a layer having a thickness of approximately 1 mm made of foamed chloroprene rubber overlying the core metal. The resistance of the rubber layer is set to about $10^{5}$ Ω by dispersing carbon therein.

In the transfer device 22, the absorbing bias applied to the recording sheet from the adsorbing bias applying roller 31 is set under the following conditions:

1. A polarity of the adsorbing bias applied to the second side of the recording sheet is opposite to a polarity of electric charge given to the recording sheet due to electric discharge generated when the recording sheet is separated from the photoconductive drums 25M, 25Y, 25C, and 25BK after passing through transfer nip parts formed between the photoconductive drums 25M, 25Y, 25C, and 25BK and the transfer bias applying devices 22M, 22C, 22Y, and 22BK, respectively.

2. The polarity of the adsorbing bias is the same as the polarity of the transfer bias, and the following relationships (1) and (2) are satisfied:

$$FPA<TB \quad (1)$$

where FPA is the adsorbing bias applied to the first side of the recording sheet, and TB is the transfer bias applied to the first side of the recording sheet via the transfer belt 22*a* to transfer a first color (i.e., magenta) toner image from the photoconductive drum 25M to the first side of the recording sheet;

$$FPA<SPA \quad (2)$$

where SPA is the adsorbing bias applied to the second side of the recording sheet.

$$FPA\leqq TB/2 \quad (3)$$

$$SPA>2FPA \quad (4)$$

$$SPA>TB \quad (5)$$

Results of experiments conducted for examining the above-described conditions are now described. A transfer bias used in the experiments is subjected to constant current control. The value of electric current set for each color equals a lower limit of electric current that provides maximum image transfer efficiency. Values of transfer bias used for the four color toner images are shown in Table 1.

TABLE 1

| | | First side of recording sheet | Second side of recording sheet |
|---|---|---|---|
| First color | Magenta | 10 μA | 9 μA |
| Second color | Yellow | 11 μA | 10 μA |
| Third color | Cyan | 11 μA | 11 μA |
| Fourth color | Black | 12 μA | 12 μA |

An experiment of sheet conveyance was conducted by feeding recording sheets having a basis weight of about 55 g/m$^2$ and a basis weight of about 75 g/m$^2$ under the above-described transfer bias conditions. The results of the experiment are shown below in Table 2.

TABLE 2

| | Occurrence of sheet jam | |
|---|---|---|
| Adsorbing bias | 55 g/m$^2$ sheet | 75 g/m$^2$ sheet |
| −30 μA | ○ | ○ |
| −20 μA | ○ | ○ |
| −10 μA | ○ | ○ |
| 0 μA | ○ | ○ |
| +5 μA | ○ | ○ |
| +6 μA | ○ | ○ |
| +10 μA | x | ○ |
| +15 μA | x | ○ |
| +20 μA | x | x |
| +30 μA | x | x |

In table 2, "○" designates that a sheet jam did not occur, and "X" designates that a sheet jam occurred. As shown in Table 2, a preferable sheet conveyance without occurrence of a sheet jam was achieved under the condition that a transfer bias for the first color was +10 μA and an adsorbing bias was +6 μA or less. When the adsorbing bias was +10 μA, the thin recording sheet having a basis weight of about 55 g/m$^2$ was wrapped around a part of the photoconductive drum 25M. When the recording sheet was wrapped around a part of a photoreceptor, a sheet jam occurred.

The reason why a sheet jam occurred is as follows. When the value of the adsorbing bias is set to +10 μA, which equals the value of the transfer bias for the first color toner image, or greater, the positive electric charge given to the recording sheet by applying an adsorbing bias from the adsorbing bias applying roller 31 to the recording sheet (while the recording sheet passes through a nip part between the adsorbing bias applying roller 31 and the transfer belt 22*a*), can not be reversed to the negative polarity due to the negative electric charge given to the recording sheet when the recording sheet is separated from the photoconductive drum 25M, after passing through a first color (i.e., magenta) transfer nip part formed between the photoconductive drum 25M and the transfer bias applying device 22M. As a result, the recording sheet keeps the positive electric charge. Thus, the recording sheet is wrapped around the part of the negatively charged photoconductive drum 25M.

Such a sheet jam, due to the wrapping of the recording sheet, typically occurs when an area of an image formed on the recording sheet is small. In this condition, because a small electrostatic latent image is formed on the photoconductive drum 25M, the surface potential of the photoconductive drum 25M equals the charging potential from −500V to −700V of the photoconductive drum 25M.

As seen from the above experiment, in order to achieve a preferable sheet conveyance without occurrence of a sheet jam, even in the case of using a thin paper as the recording sheet, the following relationship must be satisfied:

$$FPA \leqq TB/2 \quad (3)$$

where FPA is an adsorbing bias applied to the first side of the recording sheet, and TB is a transfer bias applied to the first side of the recording sheet to transfer a first color toner image (i.e., a magenta toner image) from the photoconductive drum 25M to the first side of the recording sheet.

When the polarity of the adsorbing bias is different from that of the transfer bias, as compared to the case in which the polarity of the adsorbing bias is the same as that of the transfer bias, the potential gradient between the adsorbing bias (e.g., negative) and the transfer bias for the first color toner image (e.g., positive) turns out to be steep. In this condition, when the resistance of the recording sheet decreases in a high humid condition, the positive transfer bias charge flows into the adsorbing bias applying roller 31 through the recording sheet. Therefore, it is desirable that the polarities of the adsorbing bias and the transfer bias are equal.

Figure 3:
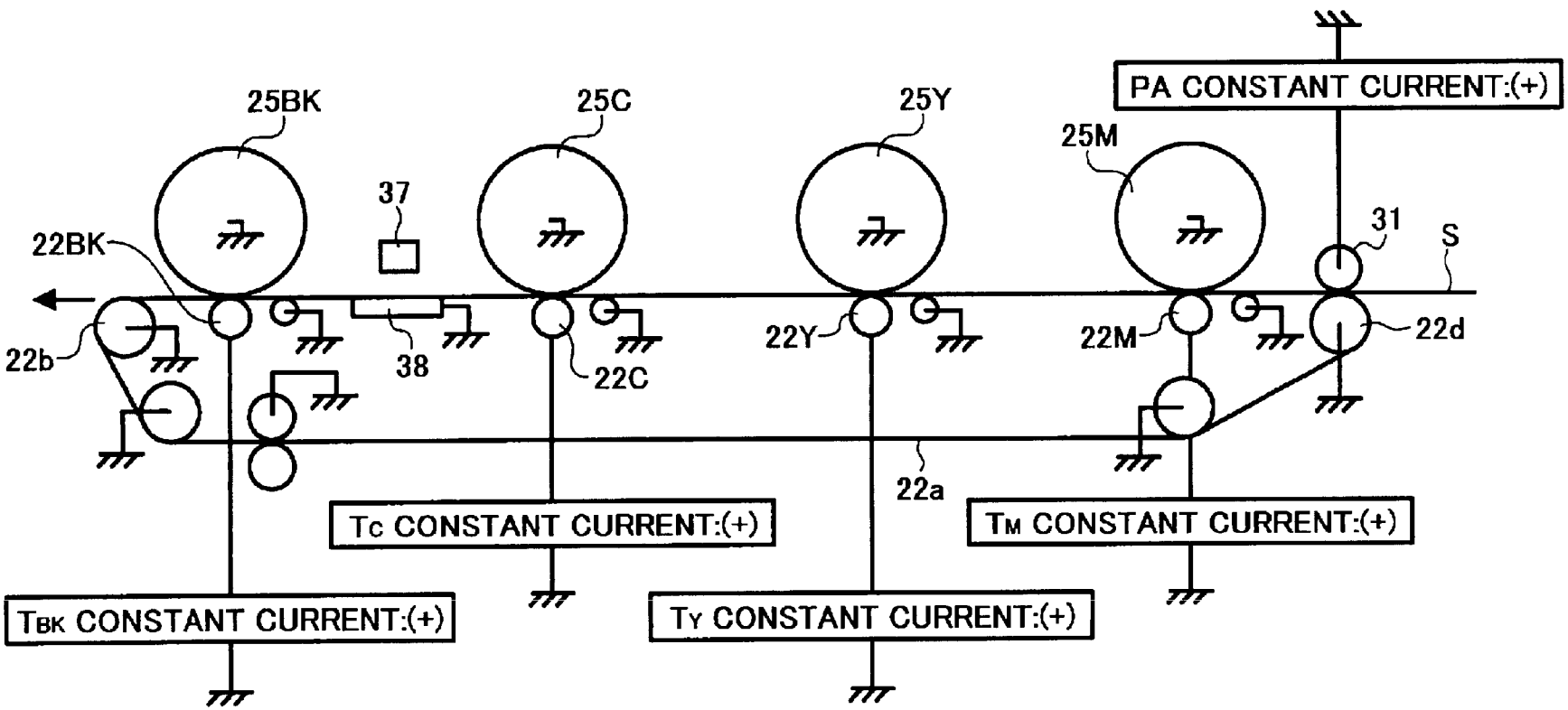
FIG. 3 is a schematic view of a device used in an experiment to find a relationship between image quality and a surface potential of a recording sheet.

The present inventors conducted a further experiment to find a relationship between image quality and the surface potential of the recording sheet. FIG. 3 is a schematic view of a device used in the experiment. As illustrated in FIG. 3, a surface potential meter 37 and a ground electrode 38 are provided between the third color (cyan) transfer nip part and the fourth color (black) transfer nip part in the sheet-moving direction to measure the surface potential of the recording sheet. The ground electrode 38 is provided opposite to the surface potential meter 37 via the transfer belt 22*a*. In FIG. 3, the reference character 22*d* designates a driven roller for the transfer belt 22*a*, a reference character "PA" designates an adsorbing bias, and reference characters "TM", "TY", "TC", and "TBK" designate "a transfer bias for transferring a magenta toner image" (a magenta transfer bias), "a transfer bias for transferring a yellow toner image" (a yellow transfer bias), "a transfer bias for transferring a cyan toner image" (a cyan transfer bias), "a transfer bias for transferring a black toner image" (a black transfer bias), respectively.

Figure 4:
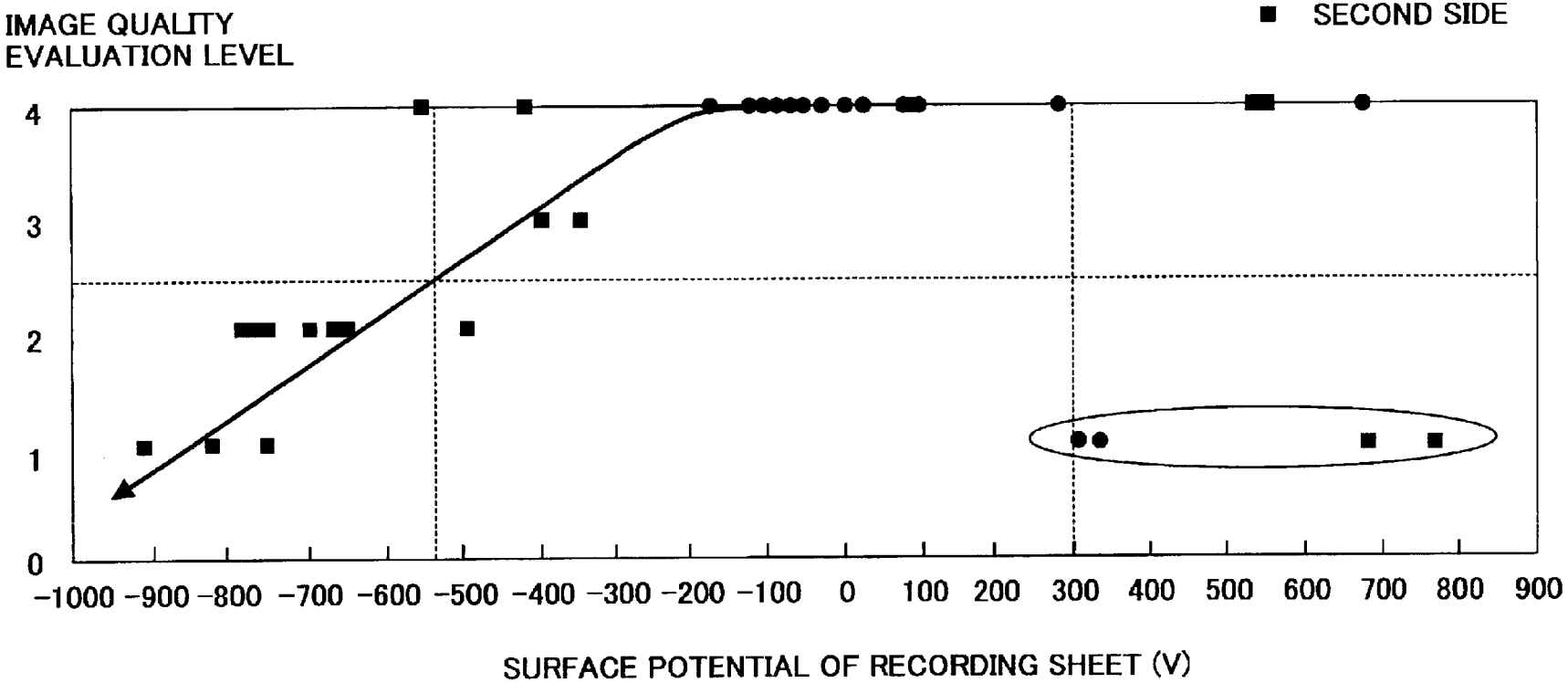
FIG. 4 is a graph showing a relationship between image quality and a surface potential of a recording sheet.

FIG. 4 is a graph showing a relationship between image quality and a surface potential of a recording sheet. The evaluation of image quality was made on a five-level basis, where the most desirable image quality was evaluated as level 4. and the most undesirable image quality was evaluated as level 0. As the image quality was degraded as indicated by the arrow, toner scattering severely occurred at the black transfer nip part. In this experiment, an allowable image quality level was 2.5 or greater. Therefore, in order to achieve the image quality level of 2.5 or greater, the surface potential of the recording sheet is required to be approximately −530V or greater after the recording sheet passes through the cyan nip part.

When the surface potential of the recording sheet after the recording sheet passes through the cyan nip part is greater than approximately +300V, a mottled image was typically formed in a halftone image. The mottled image occurred in a circled area in FIG. 4. As seen from FIG. 4, in order to achieve the image quality level of 2.5 or greater, without an occurrence of inferior images such as resulting from the toner scattering and the mottled image, the surface potential of the recording sheet is preferably in a range of approximately −530V to approximately +300V. The shaded area in FIG. 4 indicates a preferable range of the surface potential of the recording sheet and the image quality.

Next, an examination will be given to a relationship between a surface potential of the recording sheet and an adsorbing bias applied to the recording sheet.

Figure 5:
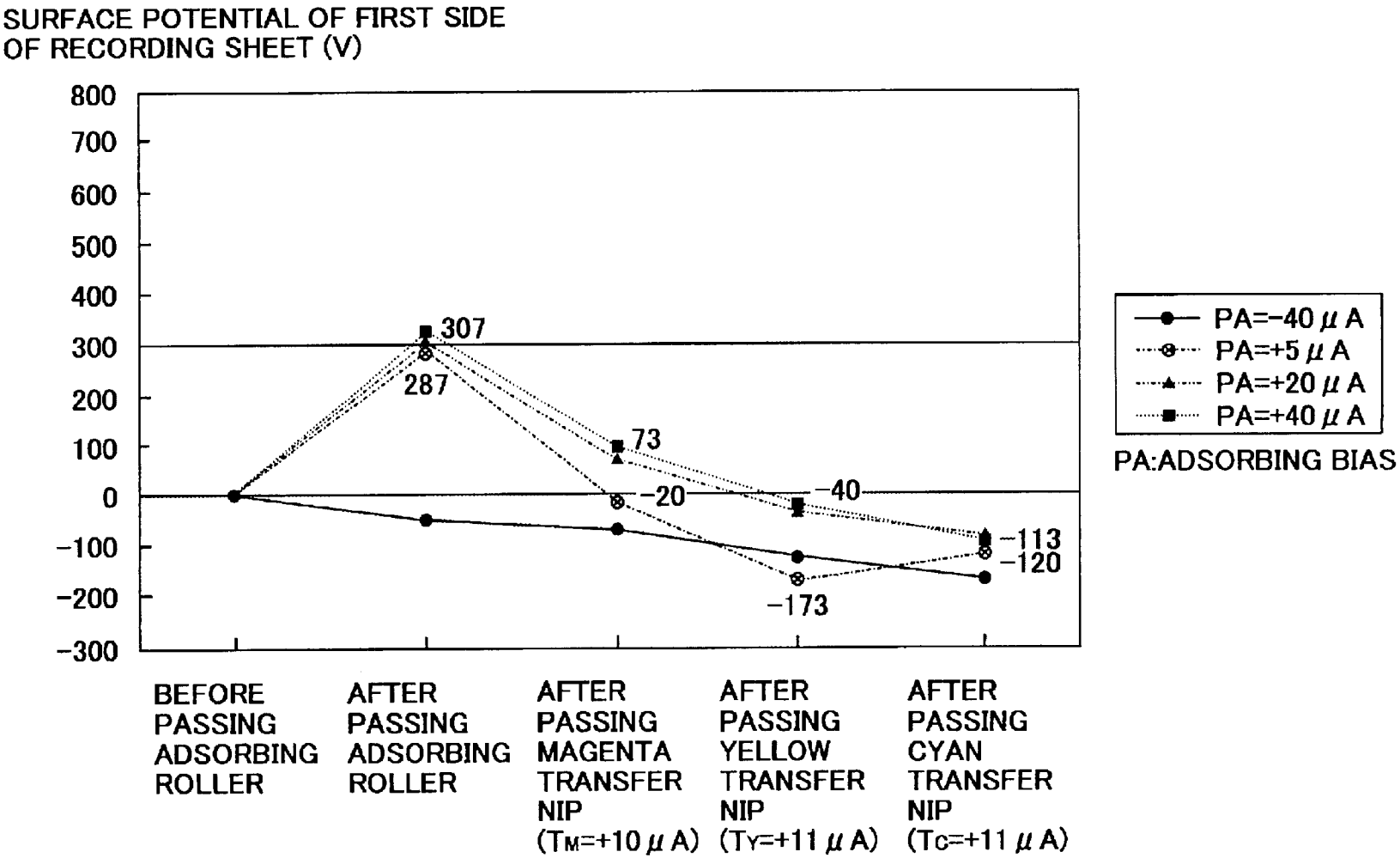
FIG. 5 is a graph showing a relationship between a surface potential of the first side of a recording sheet and an adsorbing bias applied to the first side of the recording sheet.
Figure 6:
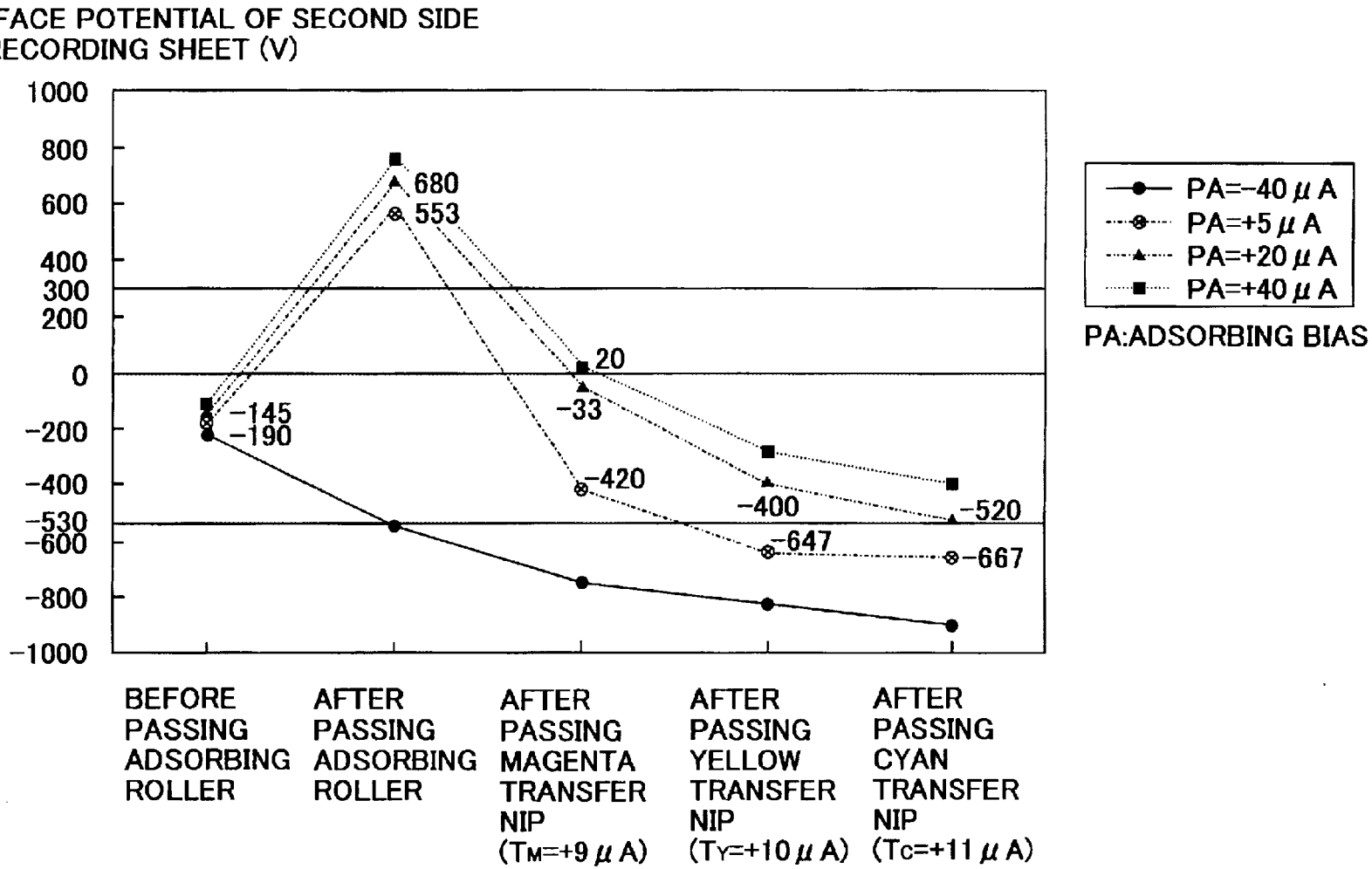
FIG. 6 is a graph showing a relationship between a surface potential of the second side of a recording sheet and an adsorbing bias applied to the second side of the recording sheet.

FIG. 5 is a graph showing a relationship between a surface potential of the first side of a thin recording sheet having a basis weight of about 55 g/m$^2$ and an adsorbing bias applied to the first side of the recording sheet. FIG. 6 is a graph showing a relationship between a surface potential of the second side of the thin recording sheet and an adsorbing bias applied to the second side of the recording sheet.

In FIGS. 5 and 6, a reference character "PA" designates an adsorbing bias, and reference characters "TM", "TY", and "TC" designate "a magenta transfer bias," "a yellow transfer bias," and "a cyan transfer bias," respectively. Further, representative values of the surface potential of the recording sheets when applying the adsorbing biases of +5 $\mu$A and +20 $\mu$A are indicated with numerals.

In FIGS. 5 and 6, as described above referring to FIG. 4, when the surface potential of the recording sheet after the recording sheet passes through the first (magenta) through third (cyan) color transfer nip parts is −530V or less, toner scattering corresponding to unallowable image quality level occurs. Further, when the surface potential of the recording sheet after the recording sheet passes through the first (magenta) through third (cyan) color transfer nip parts is +300V or greater, a mottled image is typically formed in a halftone image. When the surface potential of the recording sheet is zero, the recording sheet cannot be adsorbed to the transfer belt 22*a*. In this condition, the deviation of the position of color toner images may occur. Further, when the surface potential of the recording sheet after the recording sheet passes through the first (magenta) through third (cyan) color transfer nip parts is greater than zero (i.e., positive), a sheet jam resulting from the wrapping of the recording sheet around the photoconductive drum may occur. Such a sheet jam typically occurs when the recording sheet is a thin paper. As a result, shaded areas in a range from −530V to 0V each indicate a preferable range of the surface potential of the recording sheet for obtaining a superior image without an occurrence of a sheet jam.

Referring to FIG. 5, before the recording sheet passes the adsorbing bias applying roller 31, because the recording sheet is not charged, the surface potential of the recording sheet is about zero. As is seen from FIG. 5, when a positive adsorbing bias "PA" is applied from the adsorbing bias applying roller 31 to the recording sheet, the recording sheet is positively charged, and when a negative adsorbing bias "PA" is applied from the adsorbing bias applying roller 31 to the recording sheet, the recording sheet is negatively charged.

After the recording sheet passes through the magenta transfer nip part, when the adsorbing bias "PA" is greater than a magenta transfer bias "TM" ("TM" was +10 $\mu$A in this experiment), the recording sheet is positively charged. For example, when the adsorbing bias is +20 $\mu$A, the surface potential of the recording sheet is +73V. As described above, when the surface potential of the recording sheet after the recording sheet passes through the magenta transfer nip part is greater than zero (i.e., positive), a sheet jam may occur.

When the adsorbing bias "PA" equals the magenta transfer bias "TM", the surface potential of the recording sheet becomes nearly zero after passing through the magenta transfer nip part. In this condition, the recording sheet cannot be adsorbed to the transfer belt 22*a*, thereby causing the deviation of the position of color toner images.

When the adsorbing bias "PA" is less than the magenta transfer bias "TM", the recording sheet is negatively charged. For example, when the adsorbing bias is +5 $\mu$A, the surface potential of the recording sheet is −20V. When the surface potential is in a range of −530V to 0V, a superior image without an occurrence of a sheet jam can be obtained.

Taking the above-described results seen from FIG. 5 into consideration together with the above-described relationship (3) for achieving a preferable sheet conveyance without an occurrence of a sheet jam: FPA<TB/2 (3), where FPA is an adsorbing bias applied to the first side of the recording sheet, and TB is a transfer bias applied to the first side of the recording sheet to transfer a first color (magenta) from the photoconductive drum 25M to the first side of the recording sheet (i.e., +10 $\mu$A), it can be concluded that the adsorbing bias "PA" applied to the first side of the recording sheet is preferably +5 $\mu$A or less.

As seen from FIG. 5, each time the recording sheet passes through the transfer nip part, negative electric charge is given to the recording sheet due to the electric discharge generated when the recording sheet is separated from the negatively charged photoconductive drum at the transfer nip part. Therefore, after the recording sheet passes through the last color (black) transfer nip part, the recording sheet has large negative electric charge.

Further, after the first side of the recording sheet passes through the fixing device 1, the second side of the recording sheet is in a high resistance condition due to evaporation of water in the fixing process. Due to the high resistance condition, the second side of the recording sheet tends to be easily charged. Therefore, as compared to the first side of the recording sheet, the second side of the recording sheet is more negatively charged each time the second side of the sheet passes through the transfer nip part due to the electric discharge generated when the recording sheet is separated from the negatively charged photoconductive drum at the transfer nip part.

Onto such a negatively charged second side of the recording sheet, a negatively charged toner image is transferred from the negatively charged photoconductive drum at each transfer nip part. As a result, the negatively charged toner on the second side of the recording sheet is in an electric unstable condition.

When the recording sheet carrying such an unstable toner image is separated from the transfer belt 22*a* and is conveyed to the fixing device 1, toner of the toner image on the recording sheet causes abnormal electric discharge in the sheet conveying path, thereby causing toner scattering, resulting in a deteriorated image.

Referring to FIG. 6, before the recording sheet passes the adsorbing bias applying roller 31, the recording sheet is negatively charged due to the electric discharge generated at the transfer nip parts as described above. As is seen from FIG. 6, when a positive adsorbing bias "PA" is applied from the adsorbing bias applying roller 31 to the recording sheet, the recording sheet is positively charged, and when a negative adsorbing bias "PA" is applied from the adsorbing bias applying roller 31 to the recording sheet, the recording sheet is negatively charged.

In FIG. 6, when the adsorbing bias "PA" applied to the second side of the recording sheet equals the adsorbing bias "PA" (e.g., +5 $\mu$A) applied to the first side of the recording sheet, the surface potential of the recording sheet after passing through the cyan transfer nip part becomes less than −530V. As a result, toner scattering may occur.

When the adsorbing bias "PA" applied to the second side of the recording sheet equals twice the adsorbing bias "PA" applied to the first side of the recording sheet (e.g., +5 $\mu$A×2) or the magenta transfer bias "TM" applied to the first side of the recording sheet (i.e., +10 $\mu$A), the surface potential of the recording sheet after passing through the cyan transfer nip part becomes less than −530V. As a result, toner scattering may occur.

When the adsorbing bias "PA" applied to the second side of the recording sheet (e.g., +20 $\mu$A) is greater than twice the adsorbing bias "PA" applied to the first side of the recording sheet (e.g., 5 $\mu$A×2) or the magenta transfer bias "TM" applied to the first side of the recording sheet (i.e., +10 $\mu$A), the surface potential of the recording sheet after passing through the magenta through cyan transfer nip parts is in a range of −530V to 0V. In this range, a superior image without occurrences of toner scattering and sheet jam can be obtained. However, when the adsorbing bias "PA" applied to the second side of the recording sheet is +40 $\mu$A, the surface potential of the recording sheet after passing through the magenta transfer nip is +20V. As a result, a sheet jam may occur.

In the experiment, when the adsorbing bias "PA" applied to the first side of the recording sheet was +5 $\mu$A and the adsorbing bias "PA" applied to the second side of the recording sheet was +20 $\mu$A, an inferior sheet conveyance such as resulting from a sheet jam and an inferior image such as resulting from toner scattering and a mottled image were prevented. As a result, a stable high quality image was obtained.

The present invention has been described with respect to the embodiments as illustrated in the figures. However, the present invention is not limited to the embodiments and may be practiced otherwise.

In the above-described multi-color image forming apparatus 20, the order of forming images of respective colors and/or the arrangement of the image forming units for respective colors are not limited to the ones described above and can be practiced otherwise.

In the above embodiment, the adsorbing bias applying roller 31 is employed as an adsorbing bias applying device. In place of a roller, a member such as a blade, a brush, etc., may be employed.

Further, in the above embodiment, the transfer element is the transfer belt. However, the transfer element may be shaped in a form of a drum.

Further, in the above embodiment, the transfer bias applying devices 22M, 22C, 22Y, and 22BK employ rollers. In place of a roller, a member such as a blade, a brush, etc., may be employed.

In summary, the present embodiment achieves the following various advantages.

1. According to the embodiment, the polarity of the adsorbing bias applied to the second side of the recording sheet is opposite to the polarity of electric charge given to the recording sheet due to electric discharge generated when the recording sheet is separated from the photoconductive drums 25M, 25Y, 25C, and 25BK after passing through transfer nip parts formed between the photoconductive drums 25M, 25Y, 25C, and 25BK and the transfer bias applying devices 22M, 22C, 22Y, and 22BK, respectively. Thereby, the negative electric charge on the recording sheet due to the above-described electric discharge generated in the transfer process for the first side of the recording sheet can be discharged by applying the positive adsorbing bias to the second side of the recording sheet. Therefore, even though the negative electric charge is further given to the recording sheet due to electric discharge at each transfer nip part in the transfer process for the second side of the recording sheet, the recording sheet can be prevented from being excessively charged with a negative polarity. As a result, an occurrence of an inferior image such as resulting from toner scattering can be obviated.

2. According to the embodiment, the polarity of the adsorbing bias is the same as the polarity of the transfer bias. Therefore, as compared to a case in which the polarity of the adsorbing bias is opposite to the polarity of the transfer bias, an electric field between the adsorbing bias applying roller 31 and the transfer bias applying device 22M can be decreased. Thereby, a positive transfer bias charge is obviated from flowing into the adsorbing bias applying roller 31 through the recording sheet. As a result, an inferior transfer of a magenta toner image can be prevented.

3. According to the embodiment, the following relationship is satisfied:

$$FPA < TB \quad (1)$$

where FPA is the adsorbing bias applied to the first side of the recording sheet, and TB is the transfer bias applied to the first side of the recording sheet via the transfer belt 22*a* to transfer a first color (i.e., magenta) toner image from the photoconductive drum 25M to the first side of the recording sheet.

In the transfer process for the first side of the recording sheet, by applying the magenta transfer bias greater than the adsorbing bias to the recording sheet, which is positively charged after passing through the nip part of the adsorbing bias applying roller 31, the polarity of the charged recording sheet after passing through the magenta transfer nip part can be turned to be the same as the polarity of the photoconductive drum 25M (i.e., negative). Therefore, an occurrence of a sheet jam can be prevented.

4. According to the embodiment, the following relationship is further satisfied:

$$FPA < SPA \quad (2)$$

where SPA is the adsorbing bias applied to the second side of the recording sheet.

This condition also achieves the above advantage "1", and in addition, because the surface potential of the recording sheet in a high resistance condition after the transfer process for the first side of the recording sheet is obviated from being zero, the recording sheet is adsorbed to the transfer belt 22*a* and is adequately conveyed by the transfer belt 22*a*. As a result, an occurrence of deviation of the position of color toner images may be prevented.

5. According to the embodiment, the following relationship is further satisfied:

$$FPA \leqq TB/2 \quad (3)$$

By this condition, even though the recording sheet is a thin paper, the recording sheet is prevented from being wrapped around the part of the negatively charged photoconductive drum 25M while the recording sheet keeps positive electric charge. As a result, an inferior sheet conveyance such as resulting from a sheet jam can be obviated.

6. According to the embodiment, the following relationships are further satisfied:

$$SPA > 2FPA \quad (4)$$

$$SPA > TB \quad (5)$$

These conditions also achieve the above advantage "1".

7. According to the embodiment, by setting the value of the adsorbing bias according to the humid and resistance condition of the recording sheet, an inferior sheet conveyance, such as resulting from a sheet jam, an inferior image, such as resulting from toner scattering, a mottled image, deviation of the position of color toner images, and an inferior transfer of a first color toner image, etc., are prevented. As a result, a stable high quality image can be obtained.

Obviously, numerous additional modifications and variations of the present invention are possible in light of the above teachings. It is therefore to be understood that within the scope of the appended claims, the present invention may be practiced otherwise than as specifically described herein.

What is claimed:

1. A transfer device that transfers at least one color visual image from at least one image carrier to each of first and second sides of a recording medium, comprising:

a transfer element configured to hold and move the recording medium;

at least one transfer bias applying device configured to apply a transfer bias to the recording medium by the transfer element in order to transfer the at least one color visual image from the at least one image carrier to the recording medium while the recording medium passes through at least one transfer nip part formed between the at least one image carrier and the at least one transfer bias applying device; and an adsorbing bias applying device configured to apply a first adsorbing bias to the first side and a second adsorbing bias to the second side of the recording medium to adsorb the recording medium to the transfer element, the adsorbing bias applying device being provided upstream of the at least one transfer bias applying device in a direction of movement of the recording medium, wherein a polarity of the second adsorbing bias applied to the second side of the recording medium is opposite to a polarity of electric charge given to the recording medium due to electric discharge generated when the recording medium is separated from the at least one image carrier after passing through the at least one transfer nip part.

2. The transfer device according to claim 1, wherein the at least one transfer bias applying device includes a plurality of transfer bias applying devices, and the at least one image carrier includes a plurality of image carriers, and wherein the plurality of transfer bias applying devices apply respective transfer biases to the recording medium by the transfer element in order to transfer a plurality of color visual images of different colors from the plurality of image carriers to the recording medium, respectively, to form a superimposed color visual image.

3. The transfer device according to claim 2, wherein a polarity of the first absorbing bias and the polarity of the second adsorbing bias is equal to a respective polarity of each of the respective transfer biases, FPA<TB, wherein FPA is the first adsorbing bias applied to the first side of the recording medium, and TB is a transfer bias applied to the first side of the recording medium by the transfer element in order to transfer a first color visual image of the plurality of color visual images from one of the plurality of image carriers to the first side of the recording medium, and FPA<SPA, wherein SPA is the second adsorbing bias applied to the second side of the recording medium.

4. The transfer device according to claim 3, wherein FPA≦TB/2.

5. The transfer device according to claim 3, wherein SPA>2FPA.

6. The transfer device according to claim 3, wherein SPA>TB.

7. An image forming apparatus, comprising:

at least one image carrier configured to carry at least one color visual image;

a transfer device configured to transfer the at least one color visual image from the at least one image carrier to each of first and second sides of a recording medium, the transfer device comprising:

a transfer element configured to hold and move the recording medium;

at least one transfer bias applying device configured to apply a transfer bias to the recording medium by the transfer element in order to transfer the at least one color visual image from the at least one image carrier to the recording medium while the recording medium passes through at least one transfer nip part formed between the at least one image carrier and the at least one transfer bias applying device; and an adsorbing bias applying device configured to apply a first adsorbing bias to the first side and a second adsorbing bias to the second side of the recording medium to adsorb the recording medium to the transfer element, the adsorbing bias applying device being provided upstream of the at least one transfer bias applying device in a direction of movement of the recording medium, wherein a polarity of the second adsorbing bias applied to the second side of the recording medium is opposite to a polarity of electric charge given to the recording medium due to electric discharge generated when the recording medium is separated from the at least one image carrier after passing through the at least one transfer nip part.

8. The image forming apparatus according to claim 7, wherein the at least one transfer bias applying device includes a plurality of transfer bias applying devices, and the at least one image carrier includes a plurality of image carriers, and wherein the plurality of transfer bias applying devices apply respective transfer biases to the recording medium by the transfer element in order to transfer a plurality of color visual images of different colors from the plurality of image carriers to the recording medium, respectively, to form a superimposed color visual image.

9. The image forming apparatus according to claim 8, wherein a polarity of the first absorbing bias and the polarity of the second adsorbing bias is equal to a respective polarity of each of the respective transfer biases, FPA<TB, wherein FPA is the first adsorbing bias applied to the first side of the recording medium, and TB is a transfer bias applied to the first side of the recording medium by the transfer element in order to transfer a first color visual image of the plurality of color visual images from one of the plurality of image carriers to the first side of the recording medium, and FPA<SPA, wherein SPA is the second adsorbing bias applied to the second side of the recording medium.

10. The image forming apparatus according to claim 9, wherein FPA≦TB/2.

11. The image forming apparatus according to claim 9, wherein SPA>2FPA.

12. The image forming apparatus according to claim 9, wherein SPA>TB.

13. A method of forming an image, comprising:

forming at least one color visual image on the at least one image carrier;

applying a first adsorbing bias to a first side and a second adsorbing bias to a second side of a recording medium to adsorb the recording medium to a transfer element from an adsorbing bias applying device;

applying a transfer bias to the recording medium from at least one transfer bias applying device by the transfer element; and transferring the at least one color visual image from the at least one image carrier to each of the first and second sides of the recording medium while the recording medium passes through at least one transfer nip part formed between the at least one image carrier and the at least one transfer bias applying device, wherein a polarity of the second adsorbing bias applied to the second side of the recording medium is opposite to a polarity of electric charge given to the recording medium due to electric discharge generated when the recording medium is separated from the at least one image carrier after passing through the at least one transfer nip part.

14. The method according to claim 13, wherein the at least one transfer bias applying device includes a plurality of transfer bias applying devices, and the at least one image carrier includes a plurality of image carriers, and wherein the step of applying a transfer bias includes applying respective transfer biases to the recording medium by the transfer element in order to transfer a plurality of color visual images of different colors from the plurality of image carriers to the recording medium, respectively, to form a superimposed color visual image.

15. The method according to claim 14, wherein a polarity of the first adsorbing bias and the polarity of the second adsorbing bias is equal to a respective polarity of each of the respective transfer biases, FPA<TB, wherein FPA is the first adsorbing bias applied to the first side of the recording medium, and TB is a transfer bias applied to the first side of the recording medium by the transfer element in order to transfer a first color visual image of the plurality of color visual images from one of the plurality of image carriers to the first side of the recording medium, and FPA<SPA, wherein SPA is the second adsorbing bias applied to the second side of the recording medium.

16. The method according to claim 15, wherein FPA≦TB/2.

17. The method according to claim 15, wherein SPA>2FPA.

18. The method according to claim 15, wherein SPA>TB.

19. An image forming apparatus, comprising:

means for carrying at least one color visual image formed thereon;

means for transferring the at least one color visual image from the carrying means to each of first and second sides of a recording medium, the transferring means comprising:

means for holding and moving the recording medium;

transfer bias applying means for applying a transfer bias to the recording medium by the holding and moving means, the transfer bias applying means applying the transfer bias to the recording medium in order to transfer the at least one color visual image from the carrying means to the recording medium while the recording medium passes through at least one transfer nip part formed between the carrying means and the transfer bias applying means; and adsorbing bias applying means for applying a first adsorbing bias to the first side and a second adsorbing bias to the second side of the recording medium to adsorb the recording medium to the holding and moving means, the adsorbing bias applying means being provided upstream of the transfer bias applying means in a direction of movement of the recording medium, wherein a polarity of the second adsorbing bias applied to the second side of the recording medium is opposite to a polarity of electric charge given to the recording medium due to electric discharge generated when the recording medium is separated from the carrying means after passing through the at least one transfer nip part.

20. The image forming apparatus according to claim 19, wherein the transfer bias applying means includes a plurality of transfer bias applying means, and the carrying means includes a plurality of carrying means, and wherein the plurality of transfer bias applying means apply respective transfer biases to the recording medium by the holding and moving means in order to transfer a plurality of color visual images of different colors from the plurality of carrying means to the recording medium, respectively, to form a superimposed color visual image.

21. The image forming apparatus according to claim 20, wherein a polarity of the first absorbing bias and the polarity of the second adsorbing bias is equal to a respective polarity of each of the respective transfer biases, FPA<TB, wherein FPA is the first adsorbing bias applied to the first side of the recording medium, and TB is a transfer bias applied to the first side of the recording medium by the holding and moving means in order to transfer a first color visual image of the plurality of color visual images from one of the plurality of carrying means to the first side of the recording medium, and FPA<SPA, wherein SPA is the second adsorbing bias applied to the second side of the recording medium.

22. The image forming apparatus according to claim 21, wherein FPA≦TB/2.

23. The image forming apparatus according to claim 21, wherein SPA>2FPA.

24. The image forming apparatus according to claim 21, wherein SPA>TB.

* * * * *